US005199574A

United States Patent [19]

Hollyfield, Jr. et al.

[11] Patent Number: 5,199,574

[45] Date of Patent: Apr. 6, 1993

[54] VIBRATING SCREEN SEPARATOR

[75] Inventors: Clifford G. Hollyfield, Jr., Rosewll; Allen S. Jackson, Atlanta, both of Ga.

[73] Assignee: J & H Equipment, Inc., Roswell, Ga.

[21] Appl. No.: 785,523

[22] Filed: Oct. 31, 1991

[51] Int. Cl.[5] ..... B07B 1/28

[52] U.S. Cl. ..... 209/315; 209/365.1; 209/409

[58] Field of Search ..... 209/315, 364, 365.1, 209/408, 409, 412, 419

[56] References Cited

U.S. PATENT DOCUMENTS

| | | | |
|---|---|---|---|
| 1,606,558 | 11/1926 | Clark | 209/365.1 X |
| 1,610,353 | 12/1926 | Bland | 209/315 X |
| 1,769,413 | 7/1930 | Binte et al. | 209/409 X |
| 2,636,605 | 4/1953 | Wilson | 209/409 X |
| 2,920,762 | 1/1960 | Muller et al. | 209/365.1 |
| 3,325,007 | 6/1967 | Erlenstadt et al. | 209/315 |
| 4,319,993 | 3/1982 | Krause | 209/412 X |
| 4,840,728 | 6/1989 | Connolly et al. | 209/409 X |
| 4,848,607 | 7/1989 | Halley | 209/412 X |

FOREIGN PATENT DOCUMENTS

| | | | |
|---|---|---|---|
| 0899156 | 1/1982 | U.S.S.R. | 209/408 |
| 1235555 | 6/1986 | U.S.S.R. | 209/365.1 |
| 1264999 | 10/1986 | U.S.S.R. | 209/365.1 |
| 9105617 | 5/1991 | World Int. Prop. O. | 209/365.1 |

*Primary Examiner*—Robert P. Olszewski

*Assistant Examiner*—James R. Bidwell

*Attorney, Agent, or Firm*—Stephen D. Carver

[57] ABSTRACT

A vibrating screen separator comprising a tuned suspension system for controlling a sifting screen and a resiliently isolated vibrator drive system for efficiently vibrating the screen cloth. The separator may be configured with stacked decks and serially connected sections involving multiple cooperating sifting planes. A rigid frame inclined above a supportive surface suspends the cloth for sifting material. The cloth is tensioned between frame sides by mounting rails, and it overlies a reinforcing subframe. The rails are tensioned by eye nuts externally accessible at the sides of the frame. Material gravitationally flows over the vibrating screen towards the discharge end. The cloth is shaken by an elongated, center strip aligned with the direction of material travel. The center strip is oscillated by the vibrator drive system disposed above it, which is coupled thereto by linkage. The tuned suspension system comprises a pair of generally cylindrical, rubber buffers mounted in shear that connect each end of the center strip to the subframe. Thus the center strip ends are resiliently isolated relative to the subframe. Through this arrangement vibrations are uniformly distributed throughout the surface area of the cloth. The vibrator drive system comprises a rotary, electric vibrator mounted in shear by sets of rubber buffers. The axis of rotation of the motor is aligned with the direction of material travel.

21 Claims, 4 Drawing Sheets

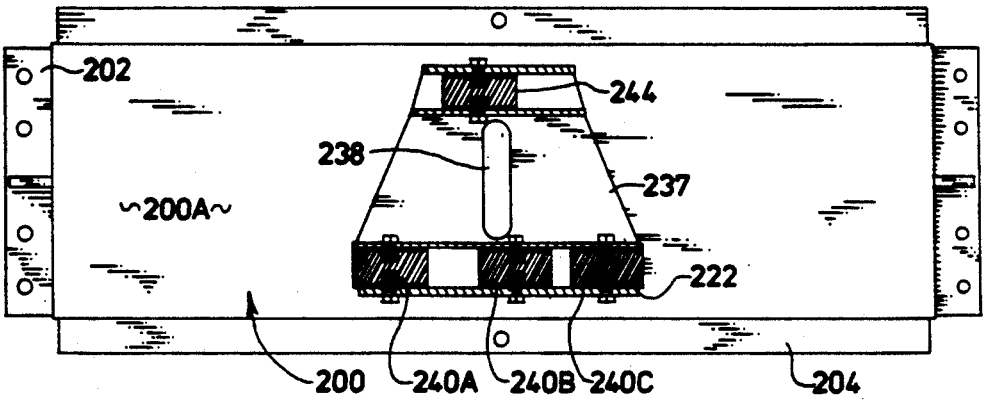
FIG. 5
FIG. 7
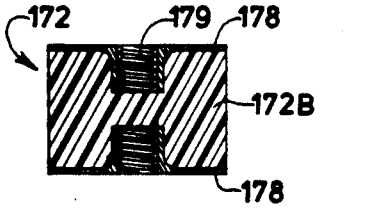
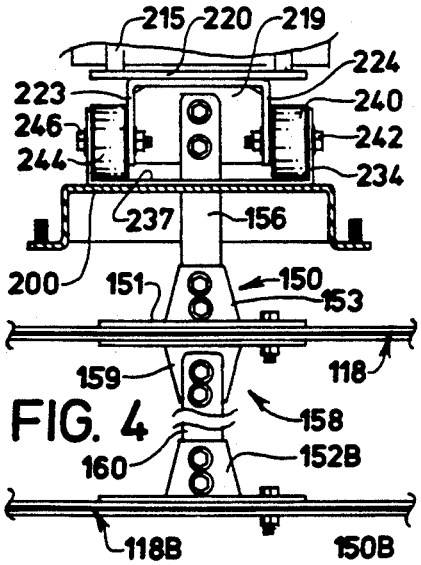
FIG. 4
FIG. 6
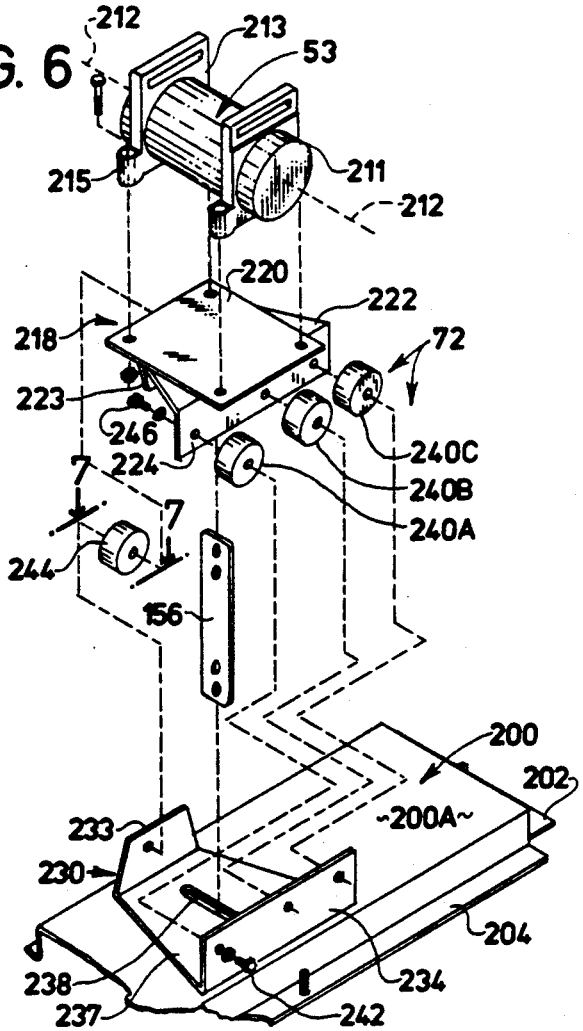

VIBRATING SCREEN SEPARATOR

BACKGROUND OF THE INVENTION

This invention relates generally to vibrating screen separator systems. More particularly, this invention relates to an improved vibrating screen system and an improved dynamically tuned suspension system for operationally mounting the vibrator and agitating the screen.

The prior art reflects numerous attempts at screen separators. In a typical screen separator, an elongated, box-like like frame of upright rigid characteristics is inclined over a supporting surface, and a screen captivated within the frame is vigorously shaken as material passes over it. Critically sized material drops through the screen, for conveyance to alternative separators or product bins and the like. A variety of different vibrators, including pneumatic, hydraulic, and rotary types, have been used.

In some prior art designs vibration is applied directly to the frame or a large, usually heavy subframe containing the screen. U.S. Pat. No. 4, 274,953 issued Jun. 23, 1981, and owned by the same assignee as in the instant case discloses a rigid supportive frame that is dynamically interconnected with an upper vibrating subframe. The mass of the entire screen subframe must be vibrated to appropriately shake the screen elements. As a consequence, a relatively large mass must be vibrated. Such designs are inappropriate for many applications since they waste considerable energy, and they tend to wear out critical parts because of the stresses and movements they involve.

Examples of typical prior art screening machines are seen in U.S. Pat. Nos. 4,882,054, 4,065,382 and 4,839,036. The latter reference mounts the screens on removable frames, which are directly shaken by pushers attached to vibrators therebelow. U.S. Pat. No. 4,065,382 discloses vibrating screen apparatus in which the screen device is maintained within a number of removable subframes, and the subframes are directly shaken by the vibrator apparatus. U.S. Pat. No. 3,630,356 discloses a system wherein a subframe of relatively rigid characteristics is independently vibrated by a lower beam.

Prior art attempts also have been made at shaking and vibrating the separating screen directly. Typical of vibrating screening machines of the latter type are Johnson patent 3,442,381 and Feller patent 3,825,118. Hahn patent 3,693,793 attempts to vibrate the screen by gyratory action. U.S. Pat. No. 3,642,133 shows a vibrating screen assembly in which a plurality of subframe screens is mounted sequentially within a frame, and each of the subframes is vibrated independently. Other attempts at vibrating screen systems are seen in U.S. Pat. Nos. 4,340,469; 4,180,458; 4,840,728; 4,855,039; 4,826,017, 3,756,407; and 3,468,418.

Numerous patents disclosing screens suitable for screen vibrating separators exist. For example, U.S. Pat. Nos. 4,491,517; 4,575,421; 4,819,809, and others are known in the art.

As will be appreciated, the screening effectiveness of a vibrating wire screen is a function of gravity and the movement of material relative to the wire screen. Too little movement of the particles will allow them to wedge in the wire cloth, too much movement will bounce the particles excessively and greatly reduce the screening capacity while also raising the dust level. The conveying capacity of a material on a vibrating wire screen is a function of slope, amplitude, frequency, load, and flow characteristics of the material. The optimum flow, amplitude, frequency, and slope relation would be one that loads the wire cloth with the maximum amount of material, but does not impede the free movement of the material. An increase in the slope or the machine or amplitude or frequency of vibration, or a reduction of the load will increase the free movement of the material.

One problem with known prior art screen separator machines is that the input of relatively large amounts of vibrational energy tends to damage the screening cloth, particularly along the mounting edges. The more energy that is inputted to a vibrating system, the greater the possibility of fatigue and destruction as time progresses. When the vibrational forces are poorly distributed about the surface of the screen, and the amount of total force necessary is aggravated. In other words, to provide functional separating along those sections of the screen that were vibrating less, a greater amount of energy must be applied at the input point. All vibrating wire screening machines will show varying amplitude rates across the face of the wire cloth (i.e., loops and nodes). The position of these loops and nodes will vary with the type of wire and wire tension.

It is known to provide a center strip of cross metal strips on a screen, and known prior art systems also have employed center strips for screen attachment that floated. Such center strips in prior art attachment designs for attaching the vibrational motor to the screen have hitherto generated poorly distributed energy patterns. In other words, the vibrational energy hitherto imparted to vibrating screens has been poorly distributed. Winquist U.S. Pat. No. 3,491,881 has this problem of vibrating too much mass.

U.S. Pat. No. 4,430,211 attempts to remedy the problem of vibrating mass by concentrating vibrations to a separate screen deck. Another attempt at aiming vibration direction at the screen subassemblies is seen in U.S. Pat. No. 3,520,408. The latter patent reference attempts to periodically contact and vibrate the screen directly by suitable crosspieces that contact the critical screen transversely to the direction of travel. While the latter approach is certainly a good one, in that less energy must generally be expended in vibrating a screen directly, rather than vibrating the whole frame or the subframe, such devices are characterized by other well known problems.

For example, it is very difficult to obtain uniform distribution of force energy upon the surface of the screen. Failure to properly distribute the energy vibrations will result in regions of high vibration separated from regions of low vibrations. The inefficiency of material handling equipment characterized by irregular vibration patterns is well known. Moreover, unless the forces are balanced and properly distributed, wear and tear upon vibrated components will lead to early failure and increase the required maintenance. Therefore the primary problem is to try to find a way to minimize energy input, but when energy input is minimized, energy must be properly distributed. The difficulties in distributing energy properly along the screen can be compounded by the weight factors of the material being handled, so a resilient and capable system for applying force to the screen, in a non-destructive fashion is necessary.

We have determined to optimize the interconnection of the screen-contacting assembly, along with the orientation and mounting of the vibrational motor system, in such a way to minimize energy inputs, maximize part and component life, while at the same time widely distributing force in an even non-destructive fashion. Therefore, it is important to provide a suspension system for vibrating screen separators in which the energy imparted by the motor connection with the screen is distributed evenly throughout the surface of the screen. The driven area should internally radiate vibrations throughout the total surface of the screen, to homogeneously distribute the force, without overtensioning or overstressing the particular screen areas. Through this approach we have determined that less energy is required to drive the cloth, because the uniformity of vibration amplitude throughout the cloth surface is achieved. The tuned suspension minimizes the amplitude variations to give maximum screening effectiveness.

SUMMARY OF THE INVENTION

Our screen separator machine comprises a unique tuned suspension system for controlling the vibrating sifting cloth, and a dynamic vibrator drive system that isolates the motor and efficiently vibrates the cloth. It can be configured in a plurality of different operational configurations involving stacked decks and serially connected sections, necessitating various combinations of suspension systems and vibrator drive systems.

A typical machine comprises a rigid, generally rectangular frame adapted to be inclined above a supportive surface at between thirty to forty degrees. Material to be sifted enters a material input end of the machine, and is directed into a uniform flow of materials that travel gravitationally towards the material discharge end for escape through various output chutes.

The frame comprises a pair of rigid, spaced apart sides bordering an internal screen receptive region. Preferably a removable subframe is centered within the latter region of the frame. The subframe reinforces the main frame when the cloth is tensioned. A sifting plane established within the frame above the subframe comprises wire mesh cloth tensioned between the frame sides by suitable mounting rails. Multiple sifting planes are associated with multiple deck, multiple section arrangements. Besides resisting frame deformation, the subframe insures that the wire cloth is tensioned uniformly. User accessible eye nuts disposed at the screen sides may be conveniently adjusted to properly tension the rails and thus the screen cloth.

The middle of the screen cloth is sandwiched by a vibrating center strip that longitudinally extends along the middle of the screen, aligned with the direction of material travel. The strip is substantially centered with respect to the screen, the subframe, and the frame sides. The center strip is mechanically oscillated by a vibrator drive system preferably disposed above it, which is coupled thereto by one or more flexible links. The center strip is yieldably mounted by a tuned suspension system comprising buffers that resiliently secure the strip ends relative to the frame.

The tuned suspension system preferably comprises pairs of generally cylindrical, rubber buffers mounted in shear to the subframe adjacent each end of the center strip. Suitable plates secured to opposite ends of the buffers are mechanically secured to the center strip ends. Through this arrangement vibrations are uniformly distributed throughout: the surface areas of the cloth. The ends of the center strip terminate in resilient buffers, rather than terminating in direct mechanical contact with the frame or subframe. As a result, oscillations at the ends of the screens are not severely attenuated. At the same time what would have been reflected, unbalanced energy is distributed throughout the screen cloth surface area more uniformly.

Screen vibration is caused by a vibrator drive system preferably mounted on top of the frame. An electric vibrator is mounted on rubber buffers operating in shear. The shear mounting allows the vibrator motor to produce the required vibration with a minimum of eccentric weight. In the best mode three separate buffers are mounted on the material discharge end and a single buffer is employed at the material input end. This buffer orientation compensates for asymmetrical loading created by the inclined orientation. In addition, this vibrator orientation functions synergistically in cooperation with the strip suspension system to generate ideal vibration distribution patterns.

Energy patterns observed with our design evidence the uniform distribution of vibrational energy upon almost the entire cloth surface. Not only is vibration more uniformly distributed on the cloth with our design, but it is more effectively isolated from the frame and subframe. As a result, vibration-induced stresses are reduced. Overall machine reliability and component life are enhanced.

Thus a basic object of the present invention is to provide a highly reliable and cost effective screening machine for use in a wide variety of screening applications.

A basic object of our invention is to focus and control vibration in a screen separator machine.

Another object is to provide a dynamic suspension system that enhances energy distribution on the sifting plane.

A related object is to provide a vibrator drive system for screen separators that isolates vibration from the frame and concentrates it upon the cloth.

Another object is to minimize the number of required moving parts in a screening machine, to minimize the quantity of parts that require maintenance or periodic replacement.

Another basic object of our invention is to provide a screening machine of the character described which imparts relatively large amounts of vibrational energy to the screening cloth with a low amplitude stroke. It is a feature of the invention that the reduced amplitude stroke due to the tuned suspension construction reduces the possibility of fatigue and breakage of the vibrating parts.

Still another object of the present invention is to provide a screening machine of the character described having an extremely low noise level. It is a feature of the invention that machines constructed in accordance with the teachings herein exhibit a noise level less than OSHA requirements 85 dbA.

Yet another object of the present invention is to provide a screening and vibrating machine of the character described which maintains the motor in a fixed position even if linkage breaks. It is a feature of the present invention that motors are mounted in sheer on separate rubber buffers in the configuration for maximum safety.

Another important object of the present invention is to provide a dynamically tuned suspension system for vibrating screening machines of the character described in which the wave pattern avoids tensioning and flexing of the connecting arm where the screen is attached.

Another essential object is to provide a dynamic tuned suspension for screening machines of the character described in which sign wave energy is transmitted through the connecting arm and maximized upon the separation screen.

Another object is to reduce the effect of bouncing and tossing in screening machines of the character described, thereby more efficiently screening materials.

Yet another object is to provide a multi-sectional tuned suspension screening machine of the character described in which the screens are so mounted to allow material to flow from section to section and on to sequential screens with minimum loss of material due to "dusting."

A still further object is to provide a dynamically tuned suspension system of the character described which allows sections to be mounted in a common inclined plane, rather than being "stepped" wherein succeeding vibrating sections are mounted in planes lower than previous sections.

Still another object of the present invention is to provide a modular tuned suspension design of the character described in which modules may succeed each other serially in one inclined plane, or may be stacked above each other.

A related object is to provide a tuned suspension system of the character described for modularized deployment, in which vibrating energy may be imparted to vertically stacked screen members through one upper vibrational structure.

Yet another object is to provide a screening system of the character described which reduces plugging, and minimizes noise.

A similar object is to provide a system of the character described in which the wire cloth may be easily installed. It is a feature of the present invention that only two bolts per panel must be tightened after the cloth is in place, which is an especially advantageous feature when using multiple deck machines.

Another object of the present invention is to provide a tuned suspension system of the character described in which multiple deck machines are provided with enough space for inspection and cleaning.

Another object is to provide a system wherein screen cloth tensioning is accomplished only with the use of convenient eye nuts, thus eliminating the need for special wrenches and encouraging personnel to properly maintain the operating tension of the cloth.

A similar object is to provide a vibrating screen of the character described in which either 1800 or 3600 rpm conventional vibrators may be employed at the behest of the user for screening.

Another object of the present invention is to provide a dynamic suspension system that compensates for the angular disposition of the sifting plane.

A basic object is to provide a reliable vibrating screen separation system of the character described which may be employed with products such as glass silica, beaded glass, fertilizers, roofing granules, coke for steel production, clays and various aggregates.

Another object of the present invention is to provide a mounting system for both the screen vibration strip and the motor system that prevent "bounce and toss" of the material traveling through the screen, and widely distributes screen energy throughout its surface area.

Another basic object is to provide a vibrating screen separator assembly of the character described in which the screen is non-destructively vibrated directly, so that vibrational energy is efficiently utilized and homogeneously distributed.

A related object is to provide a screen separator device of the character described which does not directly impart vibration to the frame. It is a feature of our machine that the vibrator is isolated from the frame, and vibrations are transmitted directly to the wire cloth by a center strip whose ends are buffered to encourage force distribution.

An important object of our invention is to provide a vibrating separator of the character described which uniformly distributes vibration throughout the screen cloth surface area.

Another primary object is to provide a separator that exhibits only minimum structural vibration.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 4 is an enlarged, fragmentary, sectional view taken generally along line 4—4 of FIG. 2;

FIG. 5 is an enlarged, fragmentary, sectional view taken generally along line 5—5 of FIG. 2;

FIG. 6 is an enlarged, exploded, isometric assembly view of the preferred vibrator mounting system;

FIG. 7 is an enlarged sectional view taken generally along line 7—7 of FIG. 6;

DETAILED DESCRIPTION OF THE DRAWINGS

Figure 1:
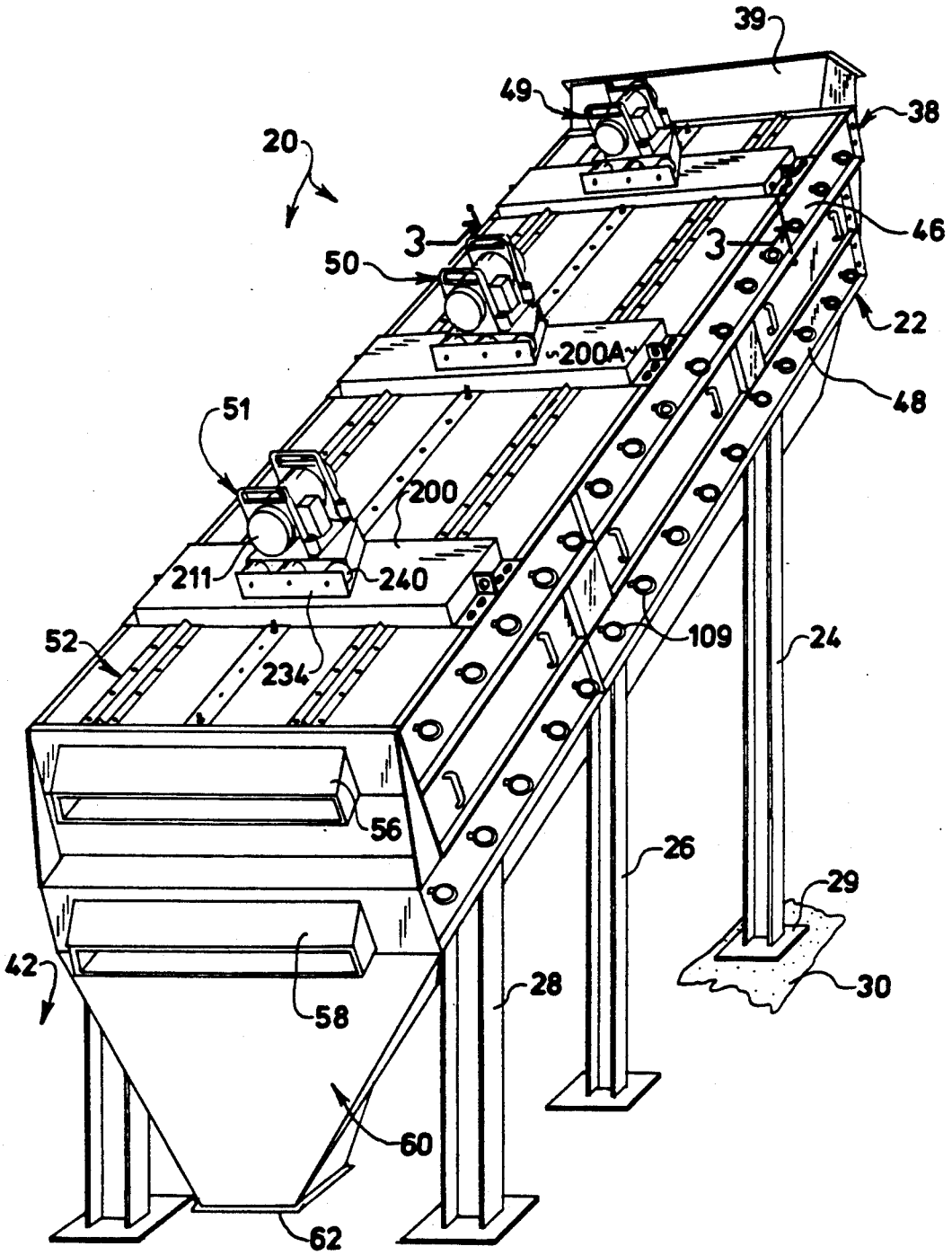
FIG. 1 is a fragmentary, perspective view of a typical double deck vibrational screening machine employing our tuned suspension and our preferred vibrator mounting system, with various parts broken away, omitted, or shown in section for clarity.

With initial reference now directed to FIG. 1 of the appended drawings, a screen separator machine constructed according to the teachings of the present invention has been generally designated by the reference numeral 20. As a preliminary matter it should be appreciated that the systems we have developed can be applied to many different configurations of vibrating separator machines involving multiple decks and serially connected sections. Therefore machine 20 is illustrative of but one possible machine configuration.

A three section multiple deck separator 20 comprises a rigid, elongated frame, generally designated by the reference numeral 22, which is somewhat in the form of a parallelepiped. Frame 22 is supported by a plurality of vertically upright stanchions 24, 26, and 28 above a lower supporting surface 30. Surface 30 is normally concrete. Stanchion foot plates 29 can be firmly bolted into the concrete surface 30 with conventional screws. Separator 20 is inclined, preferably at approximately 30 to 40 degrees, so that material entering the material input end 38 through the material input chute 39 gravitationally flows towards the material discharge end, generally designated by the reference numeral 42.

As will be recognized by those skilled in the art, machine 20 is a multi-deck machine, in that a first plurality of aligned, separating screens are disposed on top, i.e., along row 46, and a second plurality of vibrating sifting screens are disposed below in row 48. Separator 20 comprises three serially aligned vibrator stations, generally designated by the reference numerals 49, 50, and 51, which are transversely mounted over the top 52 covering the upper deck 46. Each vibrator station preferably comprises a conventional rotary electric vibrator applying approximately 1000–3000 pounds of unbalanced force, powered with three-phase alternating electric current at 1500–3600 rpm.

Thus in the disclosed configuration, three sequential screen systems are employed in each of two decks disposed within the frame to sift and separate material flowing through the apparatus. Material that does not drop through any of the screens in the upper deck can be conveyed as desired through output chute 56. Material that drops through the first deck but which does not drop through the second deck 48 is outputted through a chute 58. Material that drops through both decks collects in a conventional hopper generally designated by the reference numeral 60, which is disposed beneath the frame. The lower hopper 60 includes a conventional flange 62 for conventionally outputting fine grade material.

Figure 2:
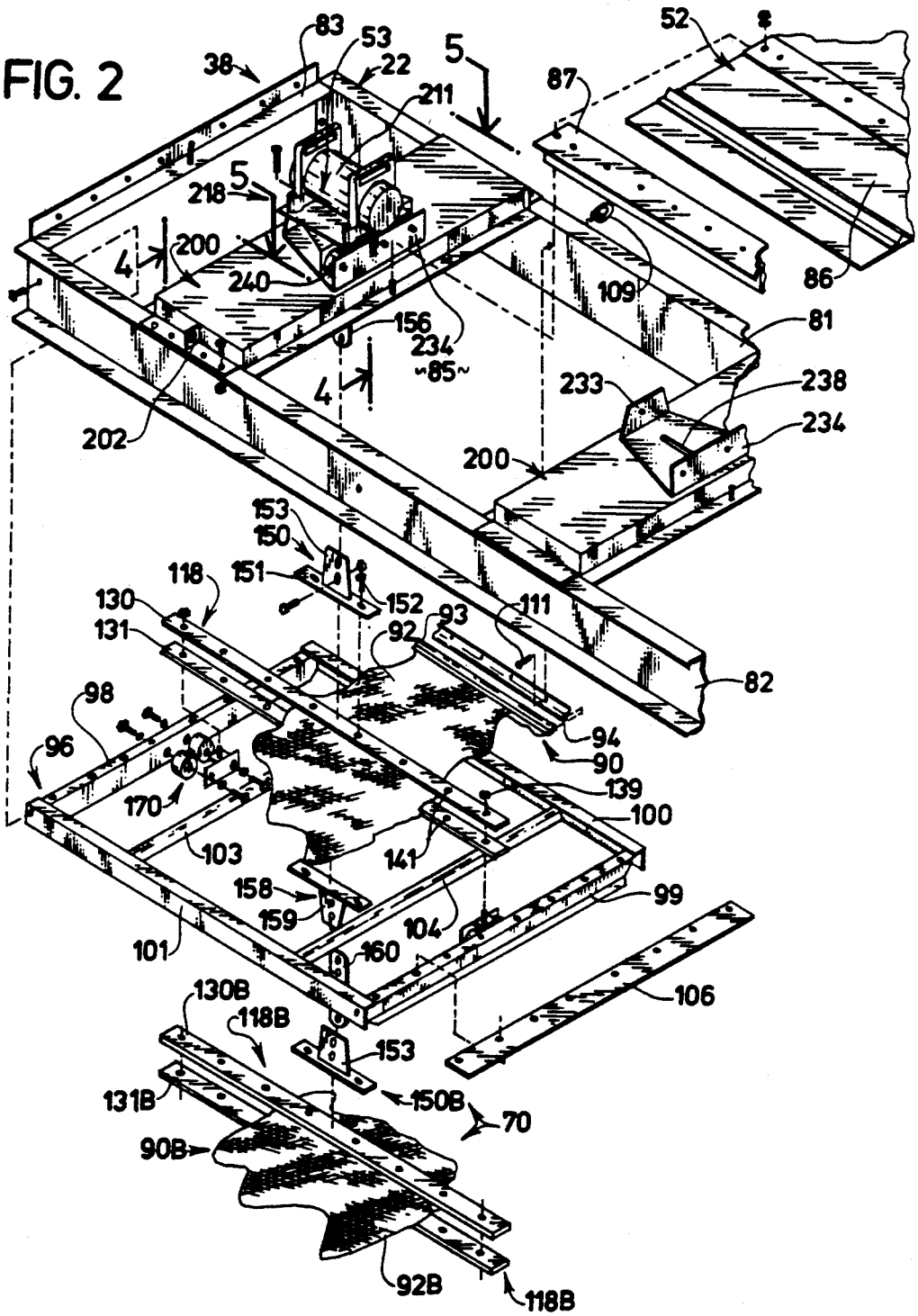
FIG. 2 is an enlarged, fragmentary, exploded, isometric view.
Figure 2B:
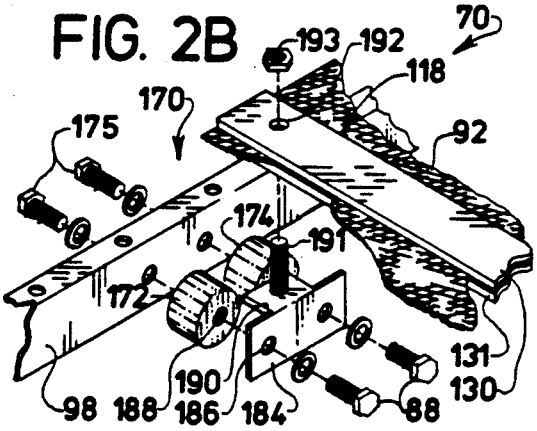
FIG. 2B is an enlarged exploded, fragmentary isometric view of the preferred strip dampening system.
Figure 3:
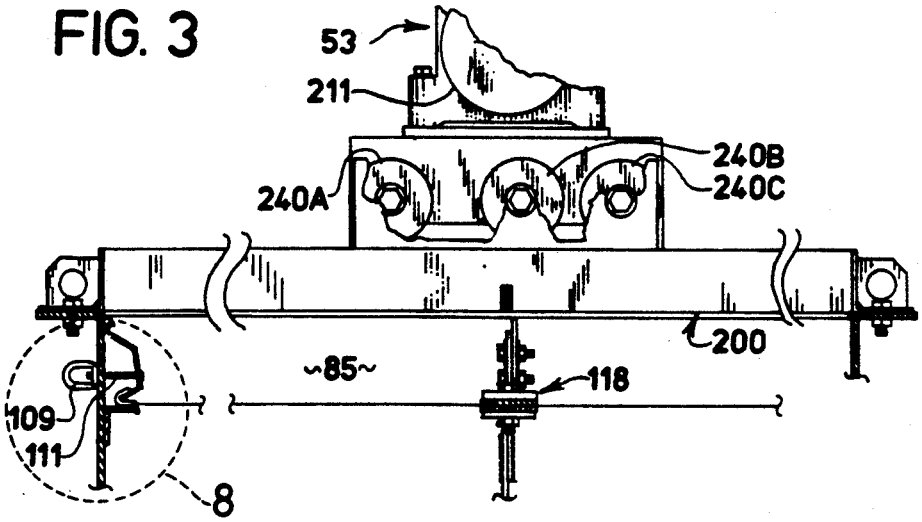
FIG. 3 is an enlarged, fragmentary sectional view taken generally along line 3—3 of FIG. 1 showing a single deck only.

With additional reference directed now to FIGS. 2, 2B and 3, our tuned suspension system for controlling the sifting screen has been generally designated by the reference numeral 70. Tuned suspension system 70 is ideally adapted for implementation in conjunction with the dynamic vibrator drive system 72 (FIGS. 4, 6). The vibrator drive system 72 and the tuned suspension system 70 function harmoniously to generate the goals and objects discussed previously herein. With the multi-deck, sequential separator machine 20, three separate suspension systems 70 are employed on each deck (for a total of six), and three separate vibrator drive systems 72 are employed. The number of vibrator drive systems 72 and tuned suspension systems 70 may be combined and deployed in different configurations as desired by the application. As will be recognized by those skilled in this art, the specific configuration depends upon the number of machine sections and decks employed.

With primary reference directed to FIG. 2, that portion of frame 22 shown is merely a fragment of the entire frame. The rigid upright frame is somewhat box-like, and it is generally in the form of a parallelepiped. Frame 22 comprises a pair of rigid, channel side members 81, 82 that are spaced apart by suitable channel ends 83. A hollow, generally rectangular screen receptive region, generally designated by the reference numeral 85, is bounded by the frame sides 81 and 82 and by frame end 83. A sifting plane is normally established by the cloth disposed within the region 85 bounded by the frame members. The frame cover 52 (FIG. 1) comprises generally planar metallic sheet segments 86 that are braced and secured by elongated cover braces 87, which extend longitudinally along the top of cover 52 and are fastened to the sides of frame 22.

A sifting plane has been generally designated by the reference numeral 90 (FIG. 2). It preferably comprises a planar, metallic cloth mesh screen 92 tensioned as hereinafter described. A lower sifting plane 90B comprising screen 92B is disposed beneath the upper deck, and is partially shown in FIG. 2. In the best mode a generally rectangular subframe 96 is precisely fitted to the frame interior between frame sides 81 and 82. The subframe insures that the frame sides do not deform in response to cloth tensioning, and that they are spaced apart properly. When the screen cloth is tensioned the subframe resists frame deformation and insures that the wire cloth is tensioned uniformly. Subframe 96 is conformed to fit within frame region 85 nestled against the frame side members. Subframe 96 comprises a transverse material input end 98 spaced apart form a parallel material discharge end 99. Ends 98 and 99 transversely extend between rigid subframe sides 100 and 101. Intermediate cross braces 103, 104 further strengthen the subframe.

Importantly, the subframe ends 98, 99 are associated with a tuned suspension system for controlling ends of the screen center vibrating strip 118. When numerous subframes are sequentially aligned, a gradual transition between subframes is aided by a cover strip 106 that extends between serially aligned subframes.

Figure 8:
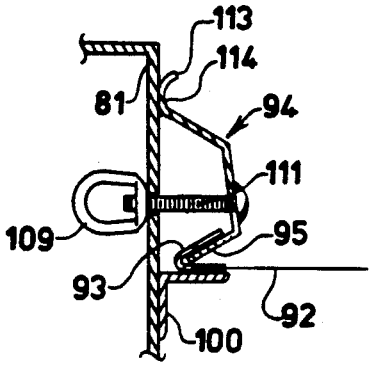
FIG. 8 is an enlarged, fragmentary sectional of the screen rails.

Both screens 92 and 92B are comprised of a resilient, planar wire cloth. The outermost edges of the screen sides are folded and crimped within elongated hook strips 93 of generally U-shaped cross section (FIG. 8). Strips 93 are a secured by suitable tensioning rails 94 to the internal frame sides. Rail foot 95 fits within the hollow interior of the hook strip 93, so that lateral displacements f rail 94 towards or away from the frame tensions or relaxes the screen cloth. As best seen in FIGS. 3 and 8, the screen is held by the opposite rails 94 positioned within screen region 85. The rails are retained by carriage bolts 111 threadably engaged by numerous eye nuts 109 mated to the shafts of the carriage bolts 111 (FIG. 8). Eye nuts 109 are manually adjustable, and they are conveniently accessible from the frame exterior. The eye nuts 109 may be conventionally twisted to tighten the screen cloth between inner frame members 81, 82.

The edges of the screen, and the rails 94, mechanically contact the subframe sides 100, as seen in FIG. 8. The rolled back top edge 114 of the rail allows it to slide as cloth is tensioned without locking into the frame sides. This ensures that the tensioning forces applied by the rail are distributed evenly into the wire mesh. It also insures that terminal end 113 neither contacts nor wears into the frame sides as vibration progresses in conjunction with normal operation.

Thus screen 92 extends between the inner sides of the frame within region 85. Of course, the rails 94 previously discussed could alternatively be associated with the sides 100, 101 of the subframe. The opposite ends of the screen (i.e., those ends of the screen that overlay subframe ends 98, 99) are not coupled to mounting rails. They are substantially free of contact with the subframe ends 98, 99 and elevated thereabove. Subframe end 99 comprises a resilient strip 106 that overlays it to form a smooth transition to the next sequential subframe. In other words, the overlay 106 covers subframe end 99, and a portion of the next subframe material receiving end 98 in assembly.

Thus the sides of screen 92 are maintained in tension by the eye nuts 109 that pull the carriage bolts 111 and rails 94. The material input end and output ends of the screen are not directly mechanically braced. Importantly the screen comprises an elongated, center vibrating strip 118 that extends longitudinally in the direction of material travel. Strip 118 is substantially centered with respect to the screen, the subframe 96 and the frame sides 81, 82. Strip 118 comprises a pair of identical, cooperating, generally rectangular halves 130 and 131 that are bolted together in aligned relationship with suitable fasteners 139. The halves 130 and 131 are metallic, and they are coupled together by the fasteners through aligned orifices 141. As appreciated from FIG. 2, the strip halves 130, 131 are tightly sandwiched about the center of the screen 92. The lower screen unit in the lower deck comprises a similar center strip 118B comprised of members 130B, 131B, tightly sandwiched about lower screen 92B.

The critical center strip 118 is directly vibrated to shake the screen 92. Strip half 130 comprises a bracket 150 having a foot 151 directly secured to strip 130 by suitable fasteners 152. An upwardly projecting link 153 emanating from foot 151 is connected to a vibrator station, as will hereinafter be described, through a flat, flexible connector 156. Connector 156 extends from the vibrator station to vigorously oscillate the center strip 118 and thus the cloth. A lower bracket 158 attached to the lower half 131 of strip 118 comprises a tab 159 projecting downwardly into contact with an apertured connector link 160 suitably fastened to tab 153 on the lower bracket 150B (FIGS. 2, 4). Bracket 150B is affixed to lower vibrating center strip 118B at the lower deck. For additional deck levels additional links corresponding to links 160 can be interconnected with lower screens. Each link is lightweight, flat and flexible. Thus vibrations imparted from the upper vibrator station directly to the vibrating strip 118 are linked downwardly to the lower subframe screen(s) 92B through the connector apparatus 160.

Importantly, the extreme ends strip halves 130, 131 are resiliently secured to the subframe ends 98, 99 by a buffer system 170 (FIG. 2, 2B). The strip buffer system 170 preferably comprises a pair of generally cylindrical, rubber buffers 172, 174 mounted in shear. For sifting applications involving material 225 degrees F. or hotter, the buffers comprise similarly-shaped cylindrical springs with threaded ends. The buffers are preferably secured by suitable fasteners 175 to the subframe ends 98 and 99. These buffers are similar to that illustrated in FIG. 7.

Each buffer 172, 174 comprises a substantially cylindrical resilient rubber core 172B, terminating in identical, circular metallic ends 178 that are vulcanized to the rubber. The ends 178 comprise central, threaded bosses 179 provided for threadable reception of fasteners 175. The suspension system thus contemplates the resilient coupling of the vibrating strip opposite ends to the subframe and/or the frame. The buffers 172 and 174 could be mounted directly to the frame ends or mounted to the subframe. An elongated mounting plate 184 is secured via fasteners 88 (FIG. 2B) through orifices 186 in plate 184 to orifices 188 in the buffers 172, 174. An integral tab 190 projecting from plate 184 comprises a stud 191 that penetrates orifice 192 in vibrating strip 118 for threadable attachment of nut 193. In this manner the ends of the strips are resiliently coupled to the frame and to the subframe.

With concurrent reference now directed to FIGS. 2 - 6, the vibrator drive system 72 is preferably mounted to a transverse bridge 200 disposed on top of the frame. Bridge 200 is generally flat, but it can be arched. The bridge extends between the frame side rails 81, 82 above the sifting plane. As best seen in FIG. 6, the rigid bridge 200 is generally rectangular in plan, and it comprises suitable end feet 202 adapted to be coupled to the frame side rails 81 or 82, and side flanges 204, which integrally interconnect with the frame cover 52. The bridge supports the vibrator drive system 72, and functions in cooperation with the cover 52 to seal the apparatus from dust.

The vibrator drive system 72 comprises a ruggedized electric, rotary vibrator 53 designed for twenty-four hour operation. Vibrator 53 comprises a rigid, generally cylindrical casing 211 in which an eccentrically weighted internal shaft (not shown) rotates about an axis of rotation 212 aligned with the direction of material travel (FIG. 6). The conventional eccentric weights are adjustable so the output force can be varied. Housing 211 is braced by a pair of spaced apart mounting blocks 213 having cylindrical, orificed feet 215 adapted to be firmly secured to a first mounting plate, generally designated by the reference numeral 218 (FIG. 6).

The drive system is uniquely designed so that the motor is mounted in shear by a plurality of rubber buffers. The shear mounting allows the vibrator motor to produce the required vibration with a minimum of eccentric weight as opposed to compression mountings on steel springs. The entire drive is thus quieted and lightened. In the best mode three buffers are mounted on the "down hill side" and one buffer is mounted at the "up hill side" to compensate for asymmetrical loading created by the inclined orientation.

The first mounting plate 218 comprises a rigid, generally square plate member 220 that has been welded to a lower folded member 222 that comprises a first, downwardly projecting flange 223 and a second downwardly projecting flange 224. Flanges 223, and 224 are substantially parallel with one another, and the plane occupied by first and second flanges 223, 224, respectively is generally perpendicular to the axis of rotation 212. The first mounting plate 218 is dynamically linked to the second mounting plate 230; the rubber buffers between the flanges of the plates are mounted in shear. Second mounting plate 230 is directly secured upon the top 200A of the bridge 200. It comprises a pair of spaced apart flanges 233 and 234 which respectively mate with flanges 223 and 224 previously discussed. Flange 233 is hereinafter referred to as the "third flange;" Flange 234 is hereafter referred to as the "fourth flange." The flanges 233 and 234 are integral with a base plate portion 237. Base 237 comprises an elongated central slot 238 that allows connector 156 to extend therethrough.

Both flanges 233 and 234 occupy planes that are substantially parallel to the planes occupied by flanges 223, 224 The latter planes are also generally perpendicular to the axis of rotation 212. The second flange 224 is longer and comprises a bigger area than that of flange 223. Similarly, the fourth flange 234 is longer and of a greater area than third flange 233. As best viewed in FIG. 2, the first and third flanges 223, 233 respectively point at the material input end 38 of the separator, and the second and fourth flanges 224, 234 are aimed at the material discharge end. As best viewed in FIG. 5 buffers 240B and 240C are paired together and offset slightly from buffer 240A to resist torsional forces imposed from vibrator motor rotation.

Flange 224 is preferably dynamically interconnected with flange 234 by a trio of cylindrical, rubber drive support buffers 240A-240C secured by suitable screws 246. The configuration of the buffer array comprising buffers 240A-240C and an opposite, lesser number of buffers 244 is herein referred to as "asymmetric." A lesser number of buffers 244 unite the first and third flanges 223 and 233. Buffers 240A-240C, 244 are of a larger diameter than buffers 172, 174 previously discussed, and they are seen in cross section in FIG. 7. Thus the vibrator 53 is dynamically isolated from the bridge 200 and thus the frame by the buffer array. Buffers 240A-240C and 244, isolate vibrations from the frame, subframe, and bridge 200.

Most vibrational energy is transmitted to the connector 156, which is attached underneath vibrator plate 220 to integral, downwardly projecting tab 219 (FIG. 4), and from thence to the center plate 218 on the cloth via connectors 156, 160. Energy is conducted downwardly through the lower mounting plate 230 through slot 238 and through bridge 200 to directly contact the vibrating strip 118, secured centrally on the vibrating cloth.

The isolating action of the motor mount buffers keeps vibrations from setting up a destructive wave causing the motor to expend energy with rotational motion and flexing the connecting arm to the point of metal fatigue and failure. More of the available sign wave energy is therefore transmitted via the connecting arm to the separator screen. The similar buffers 172, 174 mounting each end of the screen strips to the frame (FIG. 2B) return the longitudinal sign waves at the terminus of their travel at the screen and cause a return wave of approximately one half the intensity of the wave at its origin. This smoothing effect helps to reduce the bounce and toss which is contrary to efficient material screening.

Figure 9:
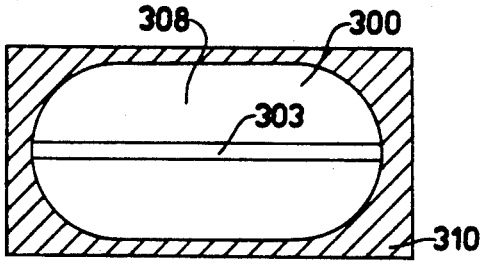
FIG. 9 PRIOR ART
FIG. 9 is a diagrammatic plan view showing typical force distribution along the top of a conventional prior art vibrating screen.
Figure 10:
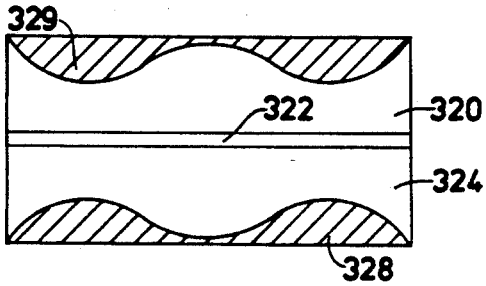
FIG. 10 PRIOR ART
FIG. 10 is a diagrammatic plan view showing force distribution along the top of our prior art vibrating screen; and, FIG. 11 is a diagrammatic top plan view of the vibrating screen of our invention, showing the novel force distribution characteristics achieved.
Figure 11:
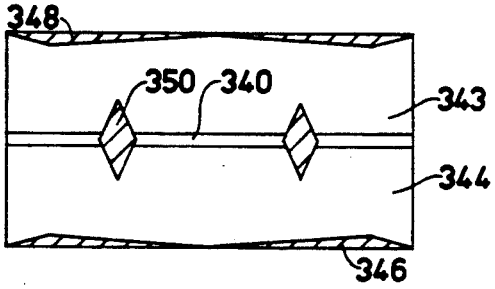

With reference now to FIGS. 9-11, FIG. 9 shows a conventional, prior art screen of generally rectangular proportions which has been generally designated by the reference 300. Screen 300 is vibrated directly by a central strip 303 that is unterminated at its ends. Vibration is haphazardly applied through conventional techniques. As a result, force is concentrated within the generally elliptical region identified by the reference numeral 308, which is surrounded by a cross hatched region 310 exhibiting substantially less vibrational lesser force.

The device of FIG. 10 comprises a screen 320 vibrated by a central piece 322 that is unterminated, although it is longer than strip 303 of FIG. 9. Again the region 324 bounded by generally sinusoidal shaped cross hatched regions 328, 329 exhibits the major force distribution. Regions 328, 329 near the boundaries or sides of the apparatus are not appropriately vibrated, so that material bunching and clogging may occur along such separators.

FIG. 11 shows the force patterns obtained through our present design. In this instance the strip 340 corresponds schematically previously described vibrating strip 118. Substantially larger regions 343, and 344 are shown in which vibration is thoroughly distributed. Although smaller, peripheral edge regions 346, 348 exist wherein vibration is less, it is natural that less vibration amplitude would exist at the termination edges of the screen. Central diamond shaped regions 350 of lesser force are of minimal area, so that the maximal areas 343, 344 accomplish the desired goals and objectives previously set forth herein.

From the foregoing, it will be seen that this invention is one well adapted to obtain all the ends and objects herein set forth, together with other advantages that are inherent to the structure.

It will be understood that: certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A vibrating screen separator comprising:

a material input end and at least one spaced apart material discharge end, wherein material travels from said input end towards said discharge end;

a rigid, elongated frame adapted to be disposed upon a supporting surface, said frame comprising a pair of spaced apart sides;

a generally planar, mesh screen comprising a pair of sides tensioned in spaced apart relationship substantially within said frame and transversely with respect to the direction of material travel;

elongated strip means for directly contacting and vibrating said screen, said strip means oriented in spaced apart, generally parallel relation with respect tot said frame sides in substantial alignment with the direction of material travel;

tuned suspension means for resiliently securing said strip means relative to said frame for uniformly distributing screen vibration, said tuned suspension means comprising buffers at each end of said strip means for resiliently securing opposite ends of said strip means to said frame; and, dynamic vibrator drive means for vibrating said strip means and thus said screen, said vibrator drive means comprising a vibrator having an axis of rotation generally parallel with the direction of material travel and means for resiliently mounting said vibrator vertically spaced apart from said screen, said dynamic vibrator drive means comprising:

a first mounting plate to which said vibrator is firmly attached;

a second mounting plate secured relative to said frame; and, an symmetric array of buffers for resiliently coupling said first mounting plate to said second mounting plate.

2. The separator as defined in claim 1 wherein:

said separator comprises a generally rectangular subframe received within said frame for bracing same said subframe mounting said screen; and, said buffers are connected to opposite ends of said subframe.

3. The separator as define din claim 2 further comprising bridge means extending transversely across said frame above said screen for securing said second mounting plate.

4. The screen separator as defined in claim 3 further comprising connector means extending from said vibrator through said second mounting plate to said strip means for transmitting vibration to said strip means.

5. The screen separator as defined in claim 4 wherein said connector means is flat and flexible, and said connector means occupies a plane substantially coincident with the direction of material travel and substantially parallel with said axis of rotation, whereby torsional displacements of said connector means are resisted and proper screen control is achieved.

6. The vibrating screen separator as defined in claim 2 wherein said first mounting plate comprises a first flange and a second flange having a greater area than said first flange, said second mounting plate comprise a third flange and a fourth flange having a greater area than said third flange, said first flange being resiliently coupled to said third flange by a predetermined number of resilient buffers, and said second flange being resiliently coupled to said fourth flange by a larger number of buffers.

7. The vibrating screen separator as defined in claim 6 wherein said first and third flanges face said input end, said second and fourth flanges face said discharge end, and each of said flanges defines a plane substantially perpendicular to said axis of rotation.

8. A vibrating screen separator comprising:

a material input end and at least one spaced apart material discharge end, wherein material to be sifted travels from said input end towards said discharge end;

a rigid, generally rectangular subframe adapted to be removably coupled to said separator, said subframe having a pair of spaced apart sides and a pair of spaced apart ends transversely extending between said sides;

a generally planar, mesh screen adapted to be disposed within said separator above said subframe to form a sifting plane over which material is passed for separation, said screen comprising a pair of sides tensioned in spaced apart relationship and a pair of opposite ends;

elongated strip means for directly contacting and vibrating said screen, said strip means oriented in spaced apart, generally parallel relation with respect to said subframe sides substantially at the screen center, said strip means comprising a pair of opposite ends generally coincident with said screen ends, and said strip means substantially aligned with the direction of material travel;

tuned suspension means for resiliently securing said strip means relative to said subframe for uniformly distributing screen vibration, said tuned suspension means comprising at least one resilient buffer secured to each end of said strip means and to ends of said subframe; and, dynamic vibrator drive means for vibrating said strip means and thus said screen, said vibrator drive means comprising a rotary vibrator establishing an axis of rotation parallel with the direction of material travel and means for asymmetrically resiliently mounting said vibrator;

connector means for interconnecting said strip means with said vibrator drive means for vibrating said strip means and thus said screen.

9. The screen separator as defined in claim 8 wherein:

said dynamic vibrator drive means comprises a first mounting plate to which said vibrator is firmly attached and a second mounting plate secured relative to said frame; and, wherein said means for asymmetrically resiliently mounting said vibrator comprises a plurality of buffers coupling together said first and second mounting plates.

10. The separator as defined in claim 9 further comprising bridge means extending transversely across said machine above said screen for securing said second mounting plate.

11. The screen separator as defined in claim 9 further comprising connector means extending from said vibrator through said second mounting plate to said strip means for transmitting vibration to said strip means.

12. The screen separator as defined in claim 11 wherein said connector means is flat and flexible, and said connector means occupies a plane substantially coincident with the direction of material travel and substantially parallel with said axis of rotation, whereby torsional displacements of said connector means are resisted and proper screen control is achieved.

13. The vibrating screen separator as defined in claim 11 wherein said first mounting plate comprises a first flange and a second flange having a greater area than said first flange, said second mounting plate comprise a third flange and a fourth flange having a greater area than said third flange, said first flange being resiliently coupled to said third flange by a predetermined number of resilient buffers, and said second flange being resiliently coupled to said fourth flange by a larger number of buffers disposed in an offset configuration relative to said last mentioned predetermined number of resilient buffers.

14. The vibrating screen separator as defined in claim 13 wherein said first and third flanges face said input end, said second and fourth flanges face said discharge end, and each of said flanges defines a plane substantially perpendicular to said axis of rotation.

15. A dynamic vibrator drive system for vibrating screen separators of the type comprising a material input end and at least one spaced apart material discharge end, a generally planar, mesh screen comprising a pair of sides tensioned in spaced apart relationship substantially within said separator, and wherein material travels from said input end towards said discharge end, said drive system comprising:

a rotary vibrator establishing an axis of rotation substantially aligned with the direction of material travel;

resilient means for asymmetrically mounting said vibrator vertically spaced apart from said screen;

means for directly contacting said screen; and, connector means extending between said screen contacting means and said vibrator.

16. The system as defined in claim 15 wherein said dynamic vibrator drive system comprises:

a first mounting plate to which said vibrator is firmly attached;

a second mounting plate secured relative to said system; and, an asymmetric array of buffers for resiliently coupling said first mounting plate to said second mounting plate.

17. The system as defined in claim 16 further comprising bridge means for extending transversely across said separator above said screen for securing said second mounting plate.

18. The system as defined in claim 17 wherein said connector means is flat and flexible and occupies a plane substantially coincident with the direction of material travel and substantially parallel with said axis of rotation, whereby torsional displacements of said connector means are resisted and proper screen control is achieved.

19. The system as defined in claim 16 wherein said first mounting plate comprises a first flange and a second flange having a greater area than said first flange, said second mounting plate comprise a third flange and a fourth flange having a greater area than said third flange, said first flange being resiliently coupled to said third flange by a predetermined number of resilient buffers, and said second flange being resiliently coupled to said fourth flange by a larger number of buffers.

20. The system as defined in claim 19 wherein said first and third flanges face said input end, said second and fourth flanges face said discharge end, and each of said flanges defines a plane substantially perpendicular to said axis of rotation.

21. A vibrating screen separator comprising:

a material input end and at least one spaced apart material discharge end, wherein material travels from said input end towards said discharge end;

a rigid, elongated frame adapted to be disposed upon a supporting surface, said frame comprising a pair of spaced apart sides;

a generally planar, mesh screen comprising a pair of sides tensioned in spaced apart relationship substantially within said frame and transversely with respect to the direction of material travel;

a generally rectangular subframe received within said frame for mounting said screen;

elongated strip means for directly contact and vibrating said screen, said strip means oriented in spaced apart, generally parallel relation with respect to said frame sides in substantial alignment with the direction of material travel;

tuned suspension means for resiliently securing said strip means relative to said frame for uniformly distributing screen vibration, said tuned suspension means comprising buffers at each end of said strip means for resiliently securing opposite ends of said strip means to ends of said subframe;

dynamic vibrator drive means for vibrating said strip means and thus said screen, said vibrator drive means comprising a vibrator establishing an axis of rotation generally parallel with the direction of material travel and means for resiliently mounting said vibrator vertically spaced apart from said screen, said dynamic vibrator drive means comprising:

a first mounting plate to which said vibrator is firmly attached;

a second mounting plate secured relative to said frame; and, an asymmetric array of buffers for resiliently coupling said first mounting plate to said second mounting plate.

* * * * *